United States Patent [19]

van Lomm

[11] 4,286,040

[45] Aug. 25, 1981

[54] PROCESS FOR PREPARING AN ELECTROPHOTOGRAPHIC ELEMENT

[75] Inventor: Gerard J. E. H. van Lomm, Tegelen, Netherlands

[73] Assignee: Océ-Nederland B.V., Venlo, Netherlands

[21] Appl. No.: 65,359

[22] Filed: Aug. 9, 1979

[30] Foreign Application Priority Data

Aug. 14, 1978 [NL] Netherlands ..... 7808418

[51] Int. Cl.[3] ..... G03G 5/06

[52] U.S. Cl. ..... 430/127; 430/58; 430/59; 430/72; 430/76; 430/135; 430/141; 260/161; 260/172; 260/178

[58] Field of Search ..... 430/58, 59, 72, 76, 430/127, 130, 135; 260/161, 172, 178

[56] References Cited

U.S. PATENT DOCUMENTS

| | | | |
|---|---|---|---|
| 2,002,174 | 5/1935 | Eichwede | 260/161 X |
| 3,676,210 | 7/1972 | Shattuck et al. | 430/127 |
| 3,898,084 | 8/1975 | Champ et al. | 430/76 X |
| 3,929,488 | 12/1975 | Smith | 430/176 |
| 3,977,870 | 8/1976 | Rochlitz | 430/59 |
| 4,018,602 | 4/1977 | Chu | 430/130 |
| 4,052,210 | 10/1977 | Hectors | 430/72 |
| 4,065,254 | 12/1977 | Buhler et al. | 8/437 |
| 4,123,270 | 10/1978 | Heil et al. | 430/72 X |

FOREIGN PATENT DOCUMENTS

| | | |
|---|---|---|
| 2210693 | 12/1974 | France . |
| 7507972 | 7/1975 | Netherlands . |
| 1145374 | 3/1969 | United Kingdom . |
| 1146142 | 3/1969 | United Kingdom . |
| 1172355 | 11/1969 | United Kingdom . |
| 1296390 | 11/1972 | United Kingdom . |

OTHER PUBLICATIONS

Rath, "Konstitution und Synthese der Organischen Farbstoffe" Lehrbuch der Textilchemie, 1952, pp. 280–289.

*Primary Examiner*—Roland E. Martin, Jr.
*Attorney, Agent, or Firm*—Albert C. Johnston

[57] ABSTRACT

An electrophotographic element that comprises an electrically conductive support and a photoconductive layer containing a photosensitive azo-compound dispersed in a film-forming polymeric binder is prepared by synthesizing the photosensitive azo-compound in situ, by reaction between a diazonium compound and an azo-coupling component, in the film-forming polymeric layer on the support. The azo-compounds thus synthetized are distributed in the binder layer in an almost perfectly homogeneous form. Under an electron microscope screen scan they are not distinguishable as separate particles, even at a ten thousand fold magnification. By forming a very thin photoconductive layer in this way and coating it with a charge transporting top layer, especially useful electrophotographic elements are obtained. The invention relates also to electrophotographic elements prepared according to the process.

23 Claims, No Drawings

PROCESS FOR PREPARING AN ELECTROPHOTOGRAPHIC ELEMENT

The present invention relates to a process for preparing an electrophotographic element that comprises an electrically conductive support and a photoconductive layer containing a photosensitive azo-compound dispersed in a film-forming polymeric binder. The invention relates also to an improved electrophotographic element of that kind.

Elements of the kind mentioned are used in various types of electrophotographic copying methods, such as electro-solography, deformation imaging, and particularly in the well-known xerography.

Such copying methods are based on the production of a latent image from the original by uniformly charging and imagewise exposure of the photoconductive layer, after which the latent image is made visable by a suitable development method.

Electrophotographic elements coated with a photoconductive layer containing a film-forming polymer and a photosensitive azo-compound, in particular a mono-, bis- or trisazo compound, are disclosed, for example, in U.S. Pat. Nos. 3,898,084 and 4,052,210 and British patent specification Nos. 1,146,142; 1,296,390 and 1,145,374.

The electrophotographic elements described in the said patent specifications are prepared by finely grinding the azo-compound, homogeneously dispersing the ground material in a melt, solution or dispersion of the film-forming polymer, and coating the mixture so obtained on the conductive support. The photoconductive layer of the resulting electrophotographic elements contains the azo-compound in the form of very small pigment particles homogeneously distributed in that layer.

Such known electrophotographic elements have a number of disadvantages, such as an objectionable dark decay, a comparatively high residual charge in the portions of the photoconductive layer struck by light during imagewise exposure, and only a moderate resolving power.

The principal object of the present invention is to provide a process for preparing electrophotographic elements of the kind referred to above, whereby elements can be obtained which do not show the disadvantages mentioned above, or which show them scarcely at most.

According to the present invention, in a process for preparing an electrophotographic element of the kind mentioned above, the photosensitive azo-compound is synthetized in situ by reaction between a diazonium compound and an azo-coupling component in the film-forming polymeric binder layer on the electrically conductive support.

The azo-compounds thus synthesized are distributed in the binder layer in a substantially perfectly homogeneous form. Under an electron microscope screen scan they are not distinguishable as separate particles, not even at a ten thousand fold magnification. In contrast, in the case of photoconductive layers prepared as described in the U.S. and British patents mentioned above, the azo compounds are clearly distinguishable as separate particles.

An additional advantage of the present process is that any desired photosensitive azo-compound may be synthetized in situ in the binder layer of the photoconductive element to be prepared. Consequently, the azo-compound to be used in the electrophotographic element can be selected at will.

Examples of the photosensitive azo-compounds suitable for being synthesized in situ according to the present invention may be found in the U.S. and British patents mentioned above and also in numerous other references accessable to those skilled in the art.

Very good photoconductive layers can be obtained with bisazo-compounds that have been synthetized in situ by coupling a bis-diazonium compound having the formula 1 or 2 shown on the Formula Table annexed hereto, with an azo-coupling component having the formula 3 or 4 shown on the Formula Table. Many representatives of those groups of bisazo-compounds are outstanding, particularly with respect to their light-sensitivity, resolving power and low residual charge. Examples or remarkably effective bisazo-compounds out of the group referred to are the compounds having the formulas 10, 7 and 14 shown on the Formula Table, namely, 4,4'-[1,1'-(1,2-ethenediyl)-bis(benzene)-4,4'-diyl-bis(azo)]-bis[3-hydroxy-2-naphthalenecarboxamide] (formula 10); 4,4'-[(3,3'-dimethoxy[1,1'-biphenyl]-4,4'-diyl)-bis(azo)]-bis[3-hydroxy-N-phenyl-2-naphthalenecarboxamide] (formula 7) and 4,4'-[(3,3'-dimethoxy[1,1'-biphenyl]-4,4'-diyl)-bis(azo)[-bis8 2,4-dihydro-5-methyl-2-phenyl-3H-pyrazole-3-one] (formula 14).

The process of the present invention can be carried out in a number of different ways.

For instance, the film-forming polymer for use as a binder in the photosensitive layer, together with either the diazonium compound or the azo-coupling component, may be dissolved in a solvent. The solution thus obtained is then coated on the conductive substrate e.g. by dip coating. Subsequently, after drying the coating, the layer obtained is treated, likewise e.g. by dip coating, with a second solution containing the azo-coupling component or the diazonium compound, after which the diazonium compound and the azo-coupling component react with each other, thus forming the desired azo-compound in situ in the binder layer.

In a different, preferred embodiment, a solution is prepared which jointly contains the binder, the diazonium compound and the azo-coupling component, as well as other ingredients to be added to the layer. In that case, of course, care should be taken to assure that the solution is maintained at a pH at which the azo-compound to be synthetized in situ in the binder layer cannot yet be formed. To that end it generally is sufficient to hold the pH at a value of 5 or 6, although a pH of 4 or even lower may be required in some cases. The said solution is then applied to the conductive substrate, using e.g. the dip or rod coating technique. Then, after evaporation of the solvent, the layer thus obtained is treated with an alkaline substance, as a result of which the required synthesis can take place.

The alkaline substance to be used in the process according to this preferred embodiment may be, for example, ammonia or a 10 percent solution of 2,6-dimethylmorpholine in ethanol.

Any solvent suitable for the purpose, such for instance as water, acetone or dimethyl-formamide, may be used as the solvent for the binder, the diazonium compound and the azo-coupling component.

When the process of the invention is to be used for preparing an electrophotographic element having a very thin photoconductive layer, such for instance as a photoconductive layer having a thickness of about 4 μm or lower, the second step abovementioned, i.e. the inducement of the reaction in situ either by application of the solution containing the azo-coupling component or the diazonium compound or by the treatment with an alkaline substance, can generally be effected even though the binder layer applied during the first step is already dry. When it is desired to prepare an element having a photoconductive layer with a thickness over 4 μm, it is advisable in most cases to carry out the second step while the binder layer applied during the first step is not yet entirely dry, in order to ensure a sufficient penetration of the binder layer by the second solution or the alkaline treatment. In such a practice, however, in order to obtain layers in which the azo-compound is present in the form of submicroscopically small particles, it has been found advantageous to have a high degree of viscosity in the applied binder layer at the start of the second step, because azo-compounds synthesized in a layer having too low a viscosity may coagulate by migration to form visible particles, with the consequence that the improvements desired may not be attained to a sufficient degree. The desired improvements can be assured in practices of this kind by using as the solvent medium for the binder a mixture of a relatively volatile solvent and a substantially smaller amount of a less volatile solvent. For example, a solvent medium consisting of 10 parts of acetone and 1 part of dimethylformamide has proved to be quite useful for this purpose.

The diazonium compound to be used in the process according to the invention may have an anion derived from either an inorganic acid such, for example, as $HBF_4$, or an organic acid such, for example, as 4-methyl-benzene-sulphonic acid, 2-naphthalene-sulphonic acid or 2-benzoyl-4-hydroxy-6-methoxy-benzene-sulphonic acid.

The azo-coupling component to be used may be, for instance, in the form of a compound carrying one or more hydroxyl groups, or in the form of a pyrazolone or of a compound having an acetoacetyl group.

Th choice of the diazonium compound and the azo-coupling component is determined, of course, by the desired structure of the light-sensitive azo-compound to be synthetized in situ in the binder layer coated on the conductive substrate.

In principle, any organic film-forming polymer known for such a purpose may be used as a binder for the photosensitive layer. The binder may be an insulating binder or a charge transporting binder. Both types of binders and their applicability are known to those skilled in the art. It is an additional advantage of the present process that, in cases making use of an insulating binder, photoconductive layers can be obtained which have a mechenical strength considerably superior to that of layers containing the same insulating binder in which the azo-compound is present in the form of divided pigment particles.

Examples of binders suitable for the preparation of photosensitive layers according to the invention include the binders disclosed in the patent specifications mentioned above, for instance, those described in column 2, line 60 to column 3, line 30 of U.S. Pat. No. 3,898,084. Particularly good results can be obtained with the use of a cellulose acetate butyrate polymer or polyvinyl acetate as an insulating binder. For use as a charge transporting binder polyvinylcarbazole and polyvinylpyrene are especially suitable.

The concentration of the azo-compound formed in the photosensitive layer according to the invention may vary within wide limits. This is chiefly dependent on whether the binder used is of the insulating or the charge transporting type. When an insulating binder is used, the photoconductive layer should generally contain the azo-compound in an amount of at least 30 percent; when a charge transporting binder is used, concentrations of between 1 and 5% will usually be sufficient.

The process according to the invention is also suitable for making photoconductive layers containing two or more azo-compounds. In this way a significant increase of the spectral sensitivity of the photoconductive layer may be obtained.

Such an increase can be achieved, for instance, by coupling one diazonium compound with two or more color-determining azo-coupling components. Also, in that case, the binder can be dissolved together with the diazonium compound and the resulting solution coated on the supporting substrate, after which the layer thus formed is treated with a solution of the selected azo-coupling components. Again, however, according to a preferred embodiment of the invention, all the components, i.e. the binder, the diazonium compound and such azo-coupling components can be dissolved together in one solvent medium, as described above for synthetizing in situ only one azo-compound.

Photoconductive layers containing two or more azo-compounds synthesized in situ can also be obtained by coupling two or more color-determining diazonium compounds with one azo-coupling component. Further, several diazonium compounds can be coupled with several azo-coupling components that are different among themselves; and this, too, can be effected in any of the ways described above.

When it is desired to couple each of two or more different diazonium compounds with a special azo-coupling component that is different from the other or others to be reacted, the best result is attained if a solution of one of the diazonium compounds together with the binder and the appropriate azo-coupling component is first applied to form a very thin layer of e.g. about 1-2 μm in thickness on the supporting substrate, and subsequently this layer is overcoated in the same way with a next layer of about 1-2 μm in thickness which contains a second of the selected diazonium compounds and the azo-coupling component to be coupled with it.

The process of the invention can suitably be used to produce a pattern of photoconductive azo-compound in the photoconductive layer. For example a layer containing the diazonium compound and the azo-coupling component and having a pH value that inhibits reaction may be exposed to light through a transparent original and subsequently treated with an alkaline substance to form a pattern of photoconductive substance corresponding to the transparent original. Patterns such as letterheads or screens may be formed in this way.

The support to be used for preparing the electrophotographic element according to the invention may be either of material that is electrically conductive by itself or of material that is more or less insulating but has been made sufficiently conductive by coating it with a suitable layer. Supports of both kinds are well known in the art. If desired the conductive support may be provided with a barrier layer or the like before coating the photoconductive layer thereon.

The electrophotographic elements prepared according to the present invention can be used as such for making electrophotographic copies. In that case, in order to obtain a sufficient charge level, which in general should be of at least 200 volts, the photoconductive layer applied on the supporting substrate should generally have a thickness of at least 4 μm. For the protection of such layers, if desired, a thin top layer of a film-forming polymer having for example a thickness of 1-3 μm, may be applied on top of the photoconductive layer.

Preferably, however, the present process is used for preparing electrophotographic elements of which the photoconductive layer is not thicker than 4 μm and, preferably, not thicker than 1-2 μm. In such practices it is desirable to provide the photoconductive layer with a top layer of sufficient thickness to obtain the required minimum charge level. For that purpose, the photoconductive layer and the top layer should generally have a total thickness of at least 4 μm. The application of a top layer on the photoconductive layer has moreover the advantage that the photoconductive layer is better protected against mechanical influences, moisture, and heat, that usually act on the photoconductive layer in electrophotographic copiers. Consequently, the permanence of the electrophotographic element is increased considerably, which is especially of importance when the electrophotographic element is to be used repeatedly, as is the case in an indirect electrophotographic copying process such as xerography. As is well known, in such a process the image developed on the photoconductive layer is transferred to a receiving surface, usually plain paper, and fixed thereon; and after the transfer step the photoconductive layer is cleaned, usually by means of a brush, after which the layer can be reused.

For use in indirect electrophotographic copying processes the photoconductive layer is applied to a drum or an endless belt. In latter case the top layer to be applied must be of the charge transporting type in order to enable the injection and transport of one of the two charge carriers formed in the underlying photoconductive layer by imagewise exposure. Generally, azo-compounds as they are employed in the electrophotographic elements of the present invention will inject holes. Consequently, for this use the top layer must be a so-called p-conductor. Systems of this sort are described in detail in, for example, British patent specification No. 1,337,228 which discloses inorganic compounds and organic compounds, particularly polymers, that can be used to form top layers of the charge transporting type mentioned above.

Polyvinyl carbazole and its derivatives, as well as polyvinyl pyrene and its derivatives, as described, for example, in British patent specification No. 1,506,928, are particularly useful polymers for the said top layer.

If desired, a so-called activator may be incorporated in a top layer formed of an organic p-conductor, in order to increase its charge transporting capability. Known activators suitable for this purpose are, for example, trinitrofluorenone and the dibenzothiophenemono- and dioxides described in Dutch patent application No. 72.12511, as well as 1,3-isobenzofurandione and 1H,3H-naphtho[1,8-c,d]pyran-1,3-dione and their respective halogenated derivatives.

For the application of the top layer it is necessary, of course, to employ a solvent in which the polymer used for the photoconductive layer does not dissolve or, at most, dissolves only scarcely.

The invention and preferred ways of practicing it will be further understood from the following illustrative examples.

EXAMPLE I 0.5 of cellulose acetate butyrate was dissolved in 100 ml of acetone (solution A), and 0.1 g of the diazonium compound having formula 6 of the Formula Table was dissolved in 1 ml of dimethylformamide (solution B). The solutions A and B were then mixed. With this mixture, using the dip-coating process, a layer was applied to an electrically conductive substrate. The substrate was a plastic foil to which a coating of aluminum had been applied by vaporization, available from Westfalische Metall Industrie K.G.

After drying the layer was treated by dip-coating with a solution of 0.33 g of KOH and 1.5 g of a naphthol according to formula 5, in 125 ml of water and 375 ml of ethanol. A thin, blue-colored layer resulted, in which no particles were distinguishable even at a ten thousand fold magnification. The thickness of the layer was about 2 μm.

The azo-compound formed in situ was 4,4'-[(3,3'-dimethoxy[1,1'-biphenyl]-4,4'-diyl)-bis(azo)]-bis[3-hydroxy-N-phenyl-2-naphthalenecarboxamide] (formula 7 of the Formula Table).

EXAMPLE II 1.2 g of cellulose acetate butyrate was dissolved in 60 ml of acetone (solution A); 1 g of a naphthol according to formula 5 was dissolved in 10 ml of dimethylformamide (solution B); and 0.5 g of the diazonium compound having formula 6 was dissolved in 10 ml of dimethylformamide (solution C). The solutions A and B were mixed, after which 0.1 ml of $HBF_4$ (50%) was added to the mixture, and the resulting mix was combined with solution C. Using the dip-coating technique an electrically conductive substrate was coated with a layer of the ultimate mixture. After drying the layer was treated with a mixture of 10 ml of 2,6-dimethylmorpholine, 20 ml of isopropanol and 70 ml of ethanol.

A fair blue-colored layer resulted, in which no particles were distinguishable. The thickness of the layer was about 2 μm. The azo-compound formed in situ was the same as that in Example 1 (formula 7).

EXAMPLE III 1.2 g of polyvinyl acetate was dissolved in 60 ml of acetone (solution A). 1 g of a naphthol of formula 5 was dissolved in 10 ml of dimethylformamide (solution B), and 0.5 g of the diazonium compound of formula 6 was dissolved in 10 ml of dimethylformamide (solution C). Solutions A and B were mixed together and the resulting mix was combined with solution C. Using the dip-coating technique an electrically conductive substrate was coated with a layer of the ultimate mixture. After drying the layer was treated in an ammonia developing apparatus.

A fair blue-colored layer resulted, in which no particles were distinguishable. The thickness of the layer was between 1 and 2 μm. The azo-compound formed in situ was the same as that in Example I (formula 7).

EXAMPLE IV 0.8 g of cellulose acetate butyrate was dissolved in 40 ml of acetone (solution A), 0.633 g of a naphthol of formula 8 in 7.5 ml of dimethylformamide (solution B), and 0.408 g of the diazonium compound of formula 9 in 7.5 ml of dimethylformamide (solution C). Solutions A and B were mixed together and the resulting mix was combined with solution C. An electrically conductive substrate was coated with a layer of the ultimate mixture. After drying the layer was treated in an ammonia developing apparatus.

A fair violet-colored layer resulted, having a thickness about 1–2 μm, in which no particles were distinguishable. The azo-compound formed in situ was that of formula 10, namely: 4,4'-[1,1'(1,2-ethenediyl)-bis (benzene)-4,4'diyl)-bis(azo)]-bis[3-hydroxy-2-naphthalenecarboxamide].

EXAMPLE V

Using the dip-coating technique, the layer prepared according to Example III was overcoated with a charge transporting layer prepared as follows:

6 g of polyvinylcarbazole was dissolved in 40 ml of chlorobenzene (solution A), and 1 g of the compound of formula 11 was dissolved in 60 ml of 1,4-dioxane (solution B). The solutions A and B were mixed, and the mixture was coated on top of the layer of example III.

The resulting double layer had a thickness of about 10 μm and gave excellent results when used in a xerographic imaging system.

EXAMPLE VI

Using the dip-coating technique, the layer prepared according to Example IV was overcoated with a charge transporting layer prepared as follows:

7.5 of polyvinylcarbazole was dissolved in 50 ml of chlorobenzene (solution A), and 0.6 g of 2,4,7-trinitro-9H-fluoren-9-one (formula 12) was dissolved in 50 ml of 1,4-dioxane (solution B). Solutions A and B were mixed and coating effected with this mixture.

The resulting double layer had a thickness of about 10 μm. It yielded good results in use in a xerographic imaging system.

EXAMPLE VII 1.2 g of cellulose acetate butyrate was dissolved in 60 ml of acetone (solution A). 0.6 g of 2,4-dihydro-5-methyl-2-phenyl-3H-pyrazole-3-one (formula 13) and 0.5 g of the diazonium compound of formula 6 were each separately dissolved in 10 ml of dimethylformamide (solutions B and C). The solutions A and B were mixed together, and the resulting mixture was combined with solution C (solution D).

Further, a mixture as described in example III was prepared and was combined with the above solution D. Using the dip-coating technique, an electrically conductive substrate was coated with a 2–3 μm thick layer of the mixture so obtained. After drying the layer was treated in an ammonia developing apparatus.

The layer thus obtained contained both the azo-compound of Example I (formula 7), which is blue-colored per se, and the azo-compound of formula 14, namely, 4,4'-[3,3'-dimethoxy[1,1'-biphenyl]-4,4'-diyl)-bis(azo)]-bis[2,4-dihydro-5-methyl-2-phenyl-3 H-pyrazole-3-one], which is red-coated per se. The layer itself had a transparent brown color. Its maximum sensitivity ranged from 500 to 700 nm, while the maximum sensitivity of the layer prepared according to Example III was between 600 and 700 nm.

A photoconductive layer prepared from the above solution D had a transparent red color, and had its maximum sensitivity between 500 and 600 nm.

EXAMPLE VIII 1.2 g of cellulose acetate butyrate was dissolved in 60 ml of acetone (solution A), 1 g of a naphthol of formula 5 was dissolved in 13 ml of dimethylformamide (solution B); and 0.5 g of the diazonium compound of formula 6 was dissolved in 7 ml of dimethylformamide (solution C). The solutions A and B were mixed together and the resulting mix was combined with solution C. An electrically conductive support was coated with a layer of the ultimate mixture.

After drying the layer was treated in an ammonia developing apparatus.

A fair blue-colored layer resulted, in which no particles were distinguishable. The thickness of the layer was about 1 μm. The azo-compound formed in situ was the same as that in Example I (formula 7). This layer was very suitable for use as a charge generating layer in a double-layer system.

EXAMPLE IX

Using the dip-coating technique, the layer prepared according to Example VIII was coated with a charge transporting layer prepared as follows:

2.4 g of polyvinylcarbazole was dissolved in a mixture of 40 ml of chlorobenzene and 10 ml of 1,4-dioxane, and thereafter 0.08 g of 1H,3H-naphtho[1,8-c,d]pyran-1,3-dione (formula 16) was dissolved in the resulting mixture. This resulting mixture was applied to effect the coating.

The resulting double layer had a thickness of about 8 μm and gave excellant results when used in a xerographic imaging system.

Excellent results were also obtained by similar examples in which use was made of the activators 4,5,6,7-tetrabromo-1,3-isobenzofurandione (formula 15), 2,3,4,5,6,7-hexabromo-1H,3H-naptho[1,8-c,d]pyran-1,3-dione (formula 17), 2,4,7-trinitro-9H-fluoren-9-one (formula 12) and 1,3,7-trinitro-dibenzothiophene-5,5-dioxide (formula 11) instead of the activator of formula 16.

EXAMPLE X

Using the dip-coating technique, the layer prepared according to Example VIII was coated with a charge transporting layer prepared as follows:

6 g of vinylchloride-vinylacetate-vinylalcohol-copolymer, 1.5 g of 4,4'-thiobis[N,N-diethyl-benzeneamine] (formula 18) and 0.15 g of 4,5,6,7-tetrabromo-1,3-isobenzofurandione (formula 15) were dissolved successively in 50 ml of acetone, and the coating was effected with the resulting mixture.

The resulting double layer had a thickness of about 4 μm and gave excellent results when used in a xerographic imaging system.

Excellent results were also obtained in a xerographic imaging system when the top layer was prepared similarly except with replacement of the compound of formula 18 by the compound of formula 19, 20 or 21, namely, 4,4'-dithiobis[N,N-diethyl-benzeneamine] (formula 19), 4,4'-[1,2-ethene-diylbis(thio)]bis[N,N-diethyl-benzeneamine] (formula 20) or 4,4'-(1,3,4-oxadiazole-2,5-diyl)bis[N,N-diethyl-benzeneamine] (formula 21).

EXAMPLE XI

Using the dip-coating technique, the layer prepared according to Example VIII was coated with a charge transporting layer prepared as follows:

3.5 g of polyvinylcarbazole and 1.5 g of brominated polyvinylcarbazole (29.4% Br) were dissolved successively in 100 ml of chlorobenzene, and the coating was effected with the resulting mixture.

The resulting double layer had a thickness of about 4 μm and gave excellent results when used in a xerographic imaging system.

EXAMPLE XII

Using the dip-coating technique, the layer prepared according to Example VIII was coated with a charge transporting layer prepared as follows:

4 g of polycarbonate and 3.2 g of 4-[2-[5-[4-diethylamino-phenyl]-4,5-dihydro-1-phenyl-1H-pyrazole-3yl]ethenyl]-N,N-diethyl-benzeneamine (formula 22) were dissolved successively in 40 ml of chloroform, and the coating was effected with the resulting mixture.

The resulting double layer had a thickness of about 4 μm and gave excellent results when used in a xerographic imaging system.

EXAMPLE XIII

Using the dip-coating technique, the layer prepared according to Example VIII was coated with a charge transporting layer prepared as follows:

5.25 g of polycarbonate, 2.33 g of 4,4'-(phenylmethylene)bis[N,N-diethyl-3-methyl-benzeneamine] (formula 23) and 0.177 g of 1,3,7-trinitro-dibenzothiophene-5,5-dioxide (formula 11) were dissolved successively in 35 ml of 1,4-dioxane, and the coating was effected with the resulting mixture.

The resulting double layer had a thickness of about 5 μm and gave excellent results when used in a xerographic imaging system.

FORMULA TABLE

1

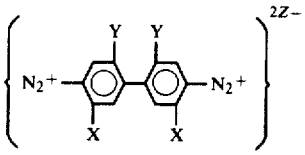

X and Y: H, OH, alkoxy (C4), alkyl (C4), halogen.
Z: inorganic or organic anion
(C4) = having up to 4 carbon atoms.

2

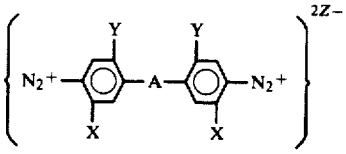

X and Y: H, OH, alkoxy (C4), alkyl (C4), halogen.
A: vinyl, oxadiazolyl, methylene, sulphide, sulphinyl, sulphonyl.
Z: inorganic or organic anion
(C4) = having up to 4 carbon atoms.

3

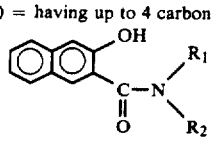

$R_1$: H, alkyl
$R_2$: H, alkyl, aryl

-continued

FORMULA TABLE

4

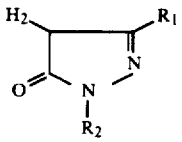

$R_1$: alkyl
$R_2$: aryl, alkyl

5

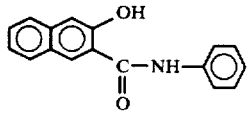

6

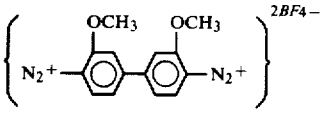

7

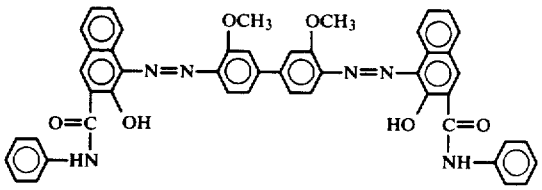

8

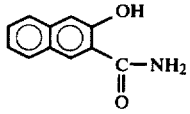

9

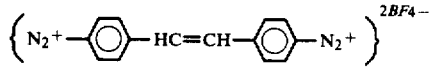

10

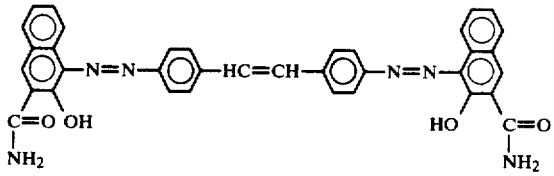

11

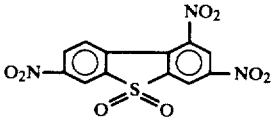

12

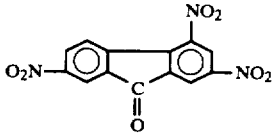

13

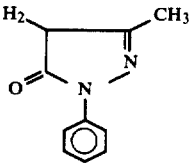

14

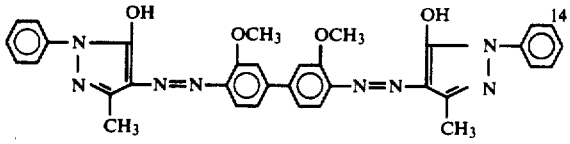

15

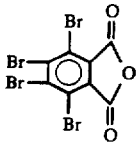

-continued

FORMULA TABLE

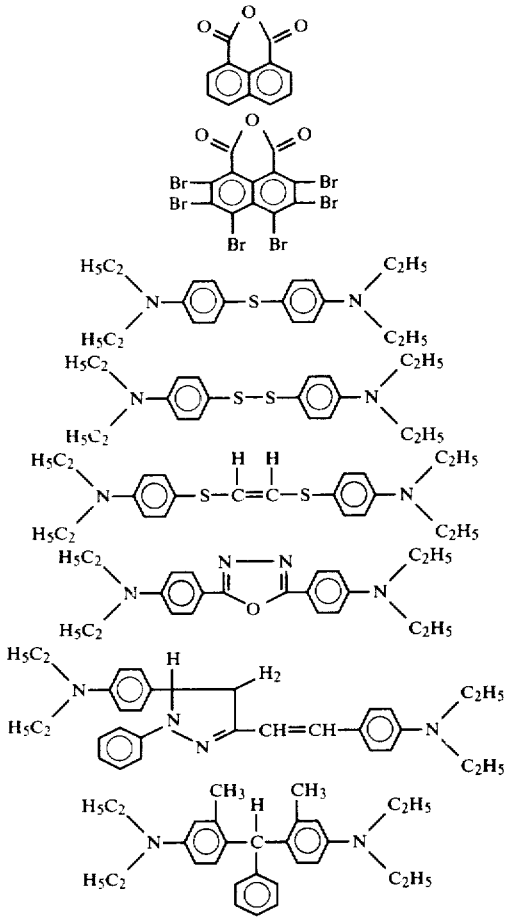

What is claimed is:

1. A process for preparing an electrophotographic element that comprises an electrically conductive support and a photoconductive layer containing a photosensitive azo-compound dispersed in a film-forming polymeric binder, which comprises synthesizing the photosensitive azo-compound in situ by reaction between a diazonium compound and an azo-coupling component in a layer of the film-forming polymeric binder on the support.

2. Process according to claim 1, said synthesizing being effected by forming into a layer on a substrate for the photoconductive layer a solution containing the binder, the diazonium compound and the azo-coupling component at a pH that inhibits said reaction and thereafter treating the formed layer with an alkaline substance that induces said reaction.

3. Process according to claim 1, said synthesizing being effected by coating onto a surface of said support a solution containing the binder and one of either the diazonium compound reactant or the azo-coupling reactant and after at least partially drying the resultant binder layer coating onto it a solution of the other of said reactants.

4. Process according to claim 2, said alkaline substance being ammonia.

5. Process according to claim 2, said alkaline substance being 2,6-dimethyl morpholine.

6. Process according to claim 2, 4 or 5, said solution comprising as the solvent for the binder, the diazonium compound and the azo-coupling component a mixture of a relatively volatile solvent and a substantially smaller amount of a less volatile solvent.

7. Process according to claim 2, 4 or 5, said solution comprising as the solvent for the binder, the diazonium compound and the azo-coupling component a mixture of acetone and dimethylformamide.

8. Process according to claim 1, 2 or 3, said diazonium compound being a diazonium compound derived from an organic acid.

9. Process according to claim 1, 2 or 3, said diazonium compound being a diazonium compound of 4-methylbenzene-sulphonic acid, 2-naphthalene-sulphonic acid or 2-benzoyl-4-hydroxy-6 methoxy-benzenesulphonic acid.

10. Process according to claim 1, 2 or 3, said synthesizing comprising coupling a diazonium compound having formula 1 of the Formula Table with an azo-coupling component having formula 3 or formula 4 of the Formula Table.

11. Process according to claim 10, the azo-compound synthesized in situ comprising a compound having formula 7 or formula 14 of the Formula Table.

12. Process according to claim 1, 2, or 3, said synthesizing comprising coupling a diazonium compound having formula 2 of the Formula Table with an azo-coupling component having formula 3 or formula 4 of the Formula Table.

13. Process according to claim 12, the azo-compound synthesized in situ comprising a compound having formula 10 of the Formula Table.

14. Process according to claim 1, 2 or 3, said binder being a cellulose acetate butyrate polymer.

15. Process according to claim 1, 2 or 3, said synthesizing comprising coupling in said binder layer a single diazonium compound with a plurality of different color-determining azo-coupling components, or a single azo-coupling component with a plurality of different color-determining diazonium compounds.

16. Process according to claim 1, 2 or 3, and after synthesizing the azo-compound in the binder layer forming on the resultant photoconductive layer a charge transporting top layer.

17. Process according to claim 16, said top layer being a layer of a substituted or non-substituted polyvinyl carbazole.

18. Process according to claim 16, said top layer being a layer of a substituted or non-substituted polyvinyl pyrene.

19. Process according to claim 3, each said coating being effected by dip-coating.

20. Process according to claim 1, 2, or 3, and by said synthesizing in situ forming said azo-compound so homogeneously distributed in said binder that separate particles of the azo-compound are not distinguishable under an electron microscope scan at 10,000-fold magnification.

21. Process according to claim 2, said layer being formed by dip-coating or rod-coating said solution onto said substrate.

22. Process according to claim 1, 2, or 3, said layer being formed to a thickness of about 1 to about 4 microns.

23. Process according to claim 16, said photoconductive layer being formed to a thickness of about 1 to about 4 microns and said charge transporting layer giving the combined photoconductive and top layers a thickness of at least about 4 microns.

* * * * *